US006502570B2

(12) United States Patent
Grady

(10) Patent No.: US 6,502,570 B2
(45) Date of Patent: Jan. 7, 2003

(54) COUNTER ADDITION FOR A RANGE TOP

(76) Inventor: Donna Marie Grady, Brookdale Rd., R.R. 1, Box 568AA, Scotrun, PA (US) 18355

( * ) Notice: Subject to any disclaimer, the term of this patent is extended or adjusted under 35 U.S.C. 154(b) by 0 days.

(21) Appl. No.: 09/861,346

(22) Filed: May 18, 2001

(65) Prior Publication Data

US 2002/0170553 A1 Nov. 21, 2002

(51) Int. Cl.[7] ..... A47B 51/00; F24C 15/00

(52) U.S. Cl. ..... 126/37 A; 126/37 R; 312/237; 312/323

(58) Field of Search ..... 126/299 C, 37 A, 126/37 R, 220, 221, 214 D, 214 A; 312/237, 323

(56) References Cited

U.S. PATENT DOCUMENTS 1,575,451 A * 3/1926 Scheib
1,854,035 A * 4/1932 Hurt
1,947,554 A * 2/1934 Kahn
1,963,281 A * 6/1934 Rogers
D98,023 S * 12/1935 Weiskittel
2,045,061 A * 6/1936 Ahrens et al.
2,109,039 A * 2/1938 Turner
2,163,258 A * 6/1939 Lautz
2,222,960 A * 11/1940 Strachan
2,333,199 A * 11/1943 Ring
2,812,415 A * 11/1957 Markowitz
2,903,549 A * 9/1959 Joseph
3,059,632 A * 10/1962 Rogers
3,289,664 A * 12/1966 Hewitt
4,082,391 A * 4/1978 Turner

FOREIGN PATENT DOCUMENTS

CA 687503 * 5/1964 ..... 126/39 H

* cited by examiner

*Primary Examiner*—Carl D Price
(74) *Attorney, Agent, or Firm*—Reed Smith LLP

(57) ABSTRACT

A cover, such as a countertop addition, is disclosed. The cover includes a primary flat section having a first perimeter sized equivalently to a second perimeter of the range top, and having an upper side and an under side. The primary flat section is fittedly integrated along the first perimeter with at least one countertop adjacent to the range top on at least one side of the range top. The primary flat section may include at least one seam, wherein, upon unfolding of said primary flat section along the at least one seam, the primary flat section is sized equivalently to the perimeter of the range top. This folding improves ease of storage, such as in a storage compartment of an adjacent countertop to the range. The primary flat section may be formed of a wood or a metallic, for example, and may include a plurality of designs thereon.

1 Claim, 6 Drawing Sheets

COUNTER ADDITION FOR A RANGE TOP

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to a method and apparatus for providing additional counter top space and, more particularly, to a counter addition for a range top.

2. Description of the Background

In general, a kitchen includes a range or range top, such as an electric range, or an electric or gas stove, having a counter top adjacent on at least one side of the range or range top. However, in a conventional kitchen, the range or range top is only in use for a small percentage of the time, i.e. during the preparation of at least one of the three meals of the day, and, for the remaining time, the counter area available for placement of materials, or for usage by members of the household in which the kitchen is present, is limited.

Although it is known to place covers over the burners of gas or electric burner stoves, the placement of burner covers prevents damage to the burners, and injury to household parties, but does not protect the remainder of the stove, other than the burners, from damage. Further, the unevenness of the surface provided by the burner covers and stove top makes use of the surface as a countertop difficult and inconvenient.

Therefore, the need exists for a range cover that protects members of the household from injury, that protects the range top from damage, and that provides a convenient countertop surface for use by the members of the household when the range is not in use.

BRIEF SUMMARY OF THE INVENTION

The present invention is directed to a cover, such as a countertop addition, for placement over a range-top. The cover includes a primary flat section having a first perimeter sized equivalently to a second perimeter of the range top, and having an upper side and an under side. The primary flat section is fittedly integrated along the first perimeter with at least one countertop adjacent to the range top on at least one side of the range top, and the fitted integration provides an additional counter space in conjunction with the at least one countertop. The primary flat section may include at least one seam, wherein, upon folding of said primary flat section along the at least one seam, an area of the first perimeter is decreased, and wherein, upon unfolding of the primary flat section, the primary flat section is sized equivalently to the second perimeter. This folding improves ease of storage, such as in a storage compartment of an adjacent countertop to the range. The primary flat section may be formed of a wood or a metallic, for example, and may include a plurality of designs thereon.

The present invention is additionally directed to a system for covering a range top. The system includes a counter top adjacent to the range top on at least one side of the range top, and a primary flat section having a first perimeter sized equivalently to a second perimeter around all sides of the range top, and having an upper side and an under side. The primary flat section is fittedly integrated along the first perimeter with the at least one countertop adjacent to the range top on the at least one side of the range top, and the fitted integration provides an additional counter space in conjunction with the at least one countertop.

The present invention solves problems experienced with the prior art because it provides a range cover that protects members of the household from injury, that protects the range top from damage, and that provides a convenient countertop surface for use by the members of the household when the range is not in use. Those and other advantages and benefits of the present invention will become apparent from the detailed description of the invention hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical kitchen device. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
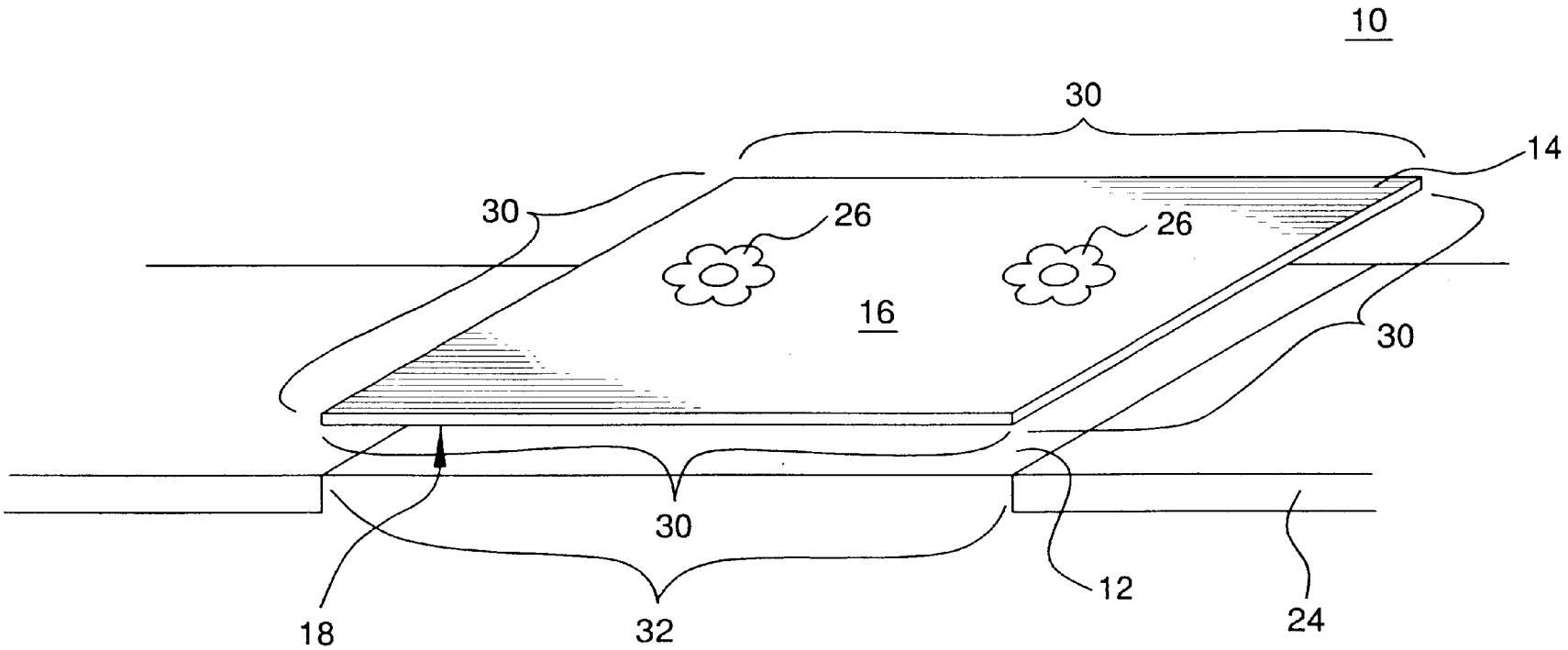
FIG. 1 is a schematic diagram illustrating a cover, such as a countertop addition, for placement over a range-top.
Figure 1A:
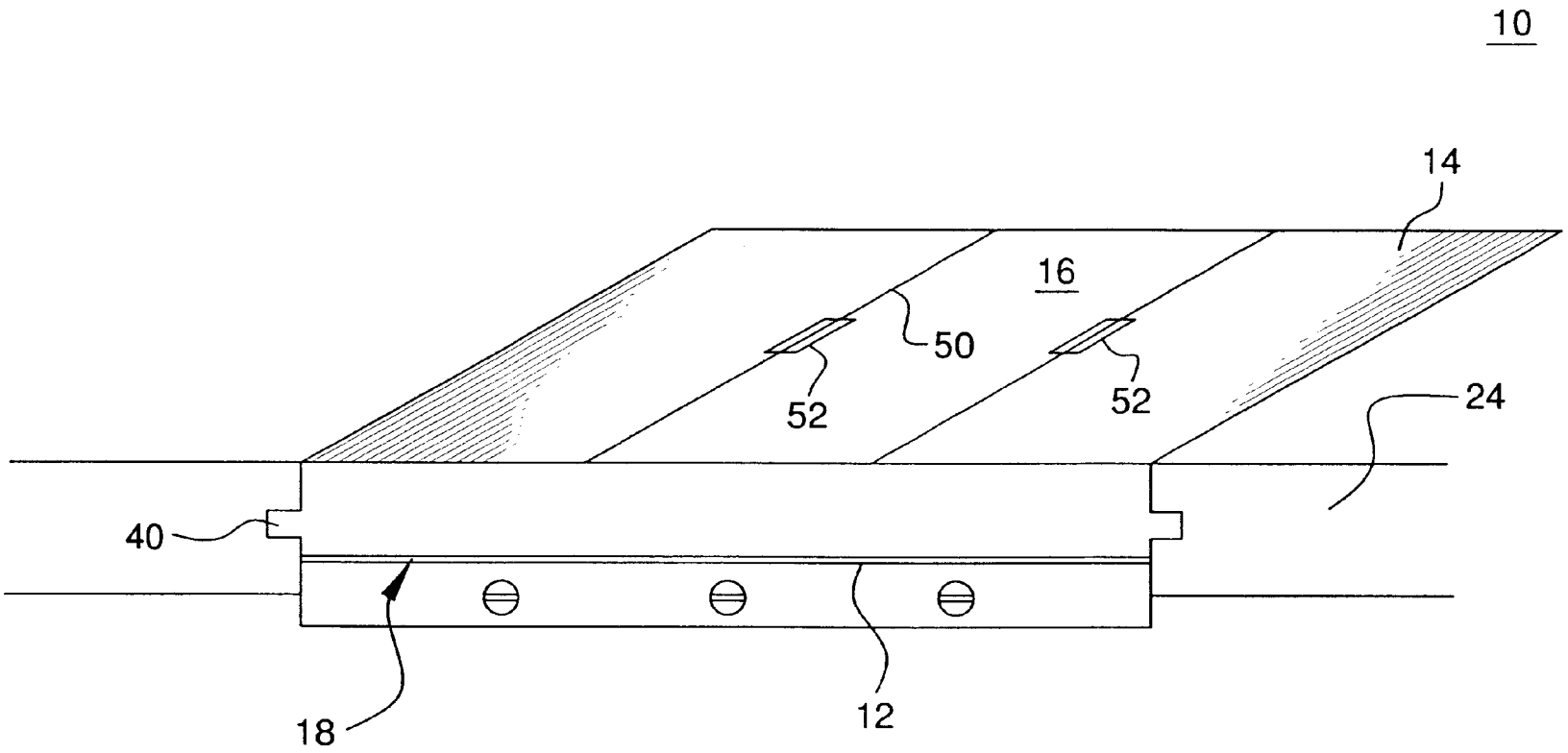
FIG. 1A is a schematic diagram illustrating a folding cover.

FIG. 1 is a schematic diagram illustrating a cover 10, such as a countertop addition, for placement over a range-top 12. As used herein, a "range", or "range top", includes an electric or gas range, range top, or an electric or gas stove or stove top. The cover 10 includes a primary flat section 14 having an upper side 16 and an under side 18.

The primary flat section 14 may be formed of wood, or a metallic, for example. The wood may be selected to match the adjacent countertop 24, and may include solid wood, or fabricated wood covered with artificial wood grain, for example. A metallic may be, for example, aluminum or tin. The primary flat section 14 may include a plurality of designs 26 thereon, such as, but not limited to, artistic designs, cartoons, or designs to match the surrounding kitchen items.

The primary flat section 14 has a first perimeter 30 around the outer edges of the flat surface sized equivalently to a second perimeter 32 around the uppermost surface of the range top 12. The primary flat section 14 is fittedly integrated along the first perimeter 30 with at least one countertop adjacent 24 to the range top 12 on at least one side of the range top 12. This fitted integration may include a small space between the counter top and the range top, or may include a locking mechanism 40, such as a tab on the cover and a slot on the countertop, that allows for a locking of the cover 10 once it is placed, with or without a spacing therebetween. This fitted integration may further include forming the upper side 16 to be at a vertical height approximately equivalent to the first vertical height of the upper surface of the at least one adjacent countertop 24. The counter top may be adjacent on one, two, or three sides of the range 12. The fitted integration provides an additional counter space in conjunction with the at least one countertop.

The primary flat section 14 may, in one embodiment of the present invention, include at least one seam 50. The primary flat section 14 may fold along the at least one seam 50, thereby decreasing the surface area within the first perimeter 30. Upon unfolding of the primary flat section 14 along the at least one seam 50, the primary flat section 14 is sized equivalently to the perimeter 32 of the range top 12. At least one hinge 52 may be included along each of the at least one seams 50, thereby allowing for the folding of the flat section 14 along the seam 50 using the hinge 52. The hinge 52 may be bi-directional, or uni-directional, and may be used to fold the flat section 14 either upper side 16 to upper side 16, or under side 18 to under side 18.

Figure 2:
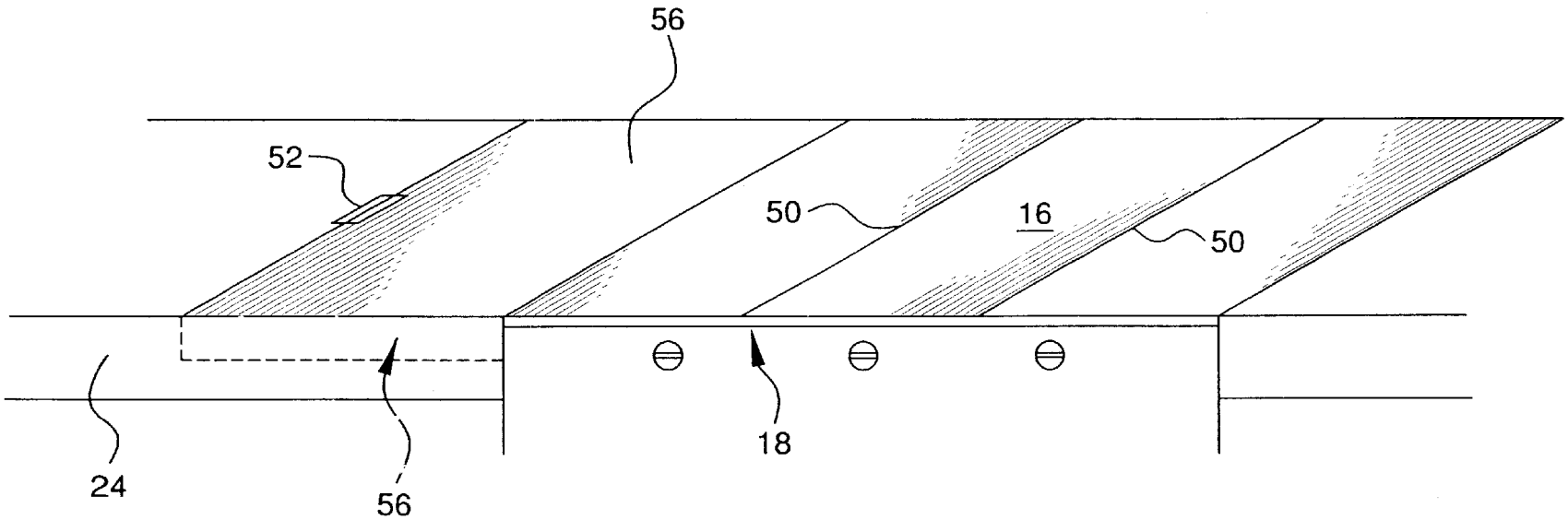
FIG. 2 is a schematic diagram illustrating the cover in use, and a storage compartment for the cover.

The folding of the primary flat section 14, and the correspondent decrease in surface area, allows for storage of the primary flat section 14 within one of the adjacent countertop 24, such as during use of the range top 12. The at least one adjacent countertop 24 may thus include therein a storage compartment 56. Upon folding of the primary flat section 14 along the at least one seam 50, the primary flat section 14 may be stored in the storage compartment 56, as shown in FIG. 2. This storage compartment 56 may be formed of a hinged section of the at least one adjacent countertop 24. Upon opening of the hinged section 56, the folded primary flat section 14 may be stored therein.

Figure 3:
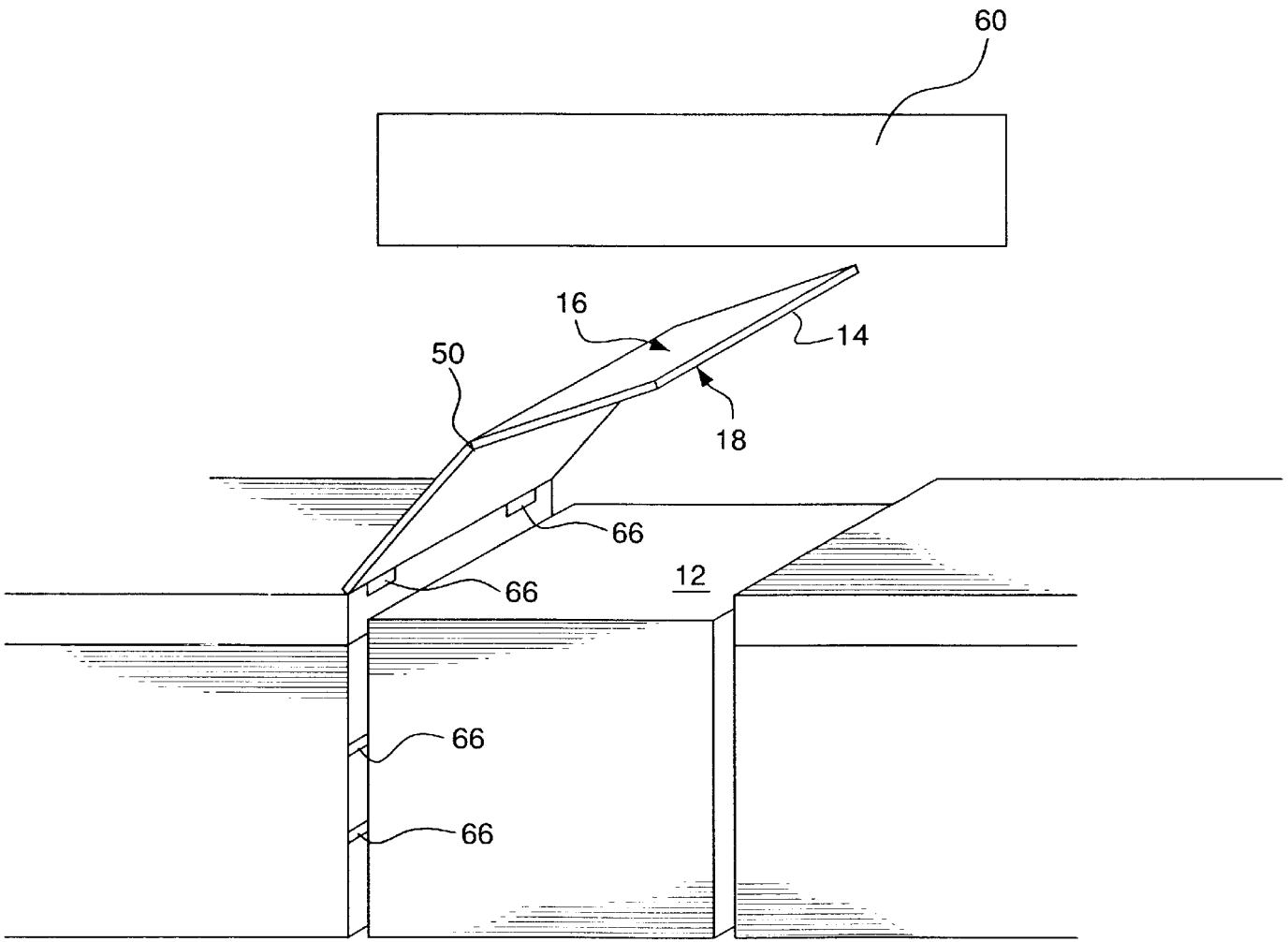
FIG. 3 is a schematic diagram illustrating folding of the cover.

In alternative embodiments of the present invention, the cover 10 may simply be folded and removed, or may be removed unfolded. Further, upon folding of the primary flat section 14 along the at least one seam 50, the primary flat section 14 may be retractably stored alongside the range top 12. For example, as shown in FIG. 3, the cover 10 may be stood upright on its edge, i.e. may be placed perpendicular to the range top 12 upper surface, and may be folded to allow the height of the cover 10 on its edge to be less than the height of, for example, the range hood 60 above the range 12. The cover 10 may then be rolled, for example, via a ball-bearing mechanism 66, down alongside the range 12.

Figure 4:
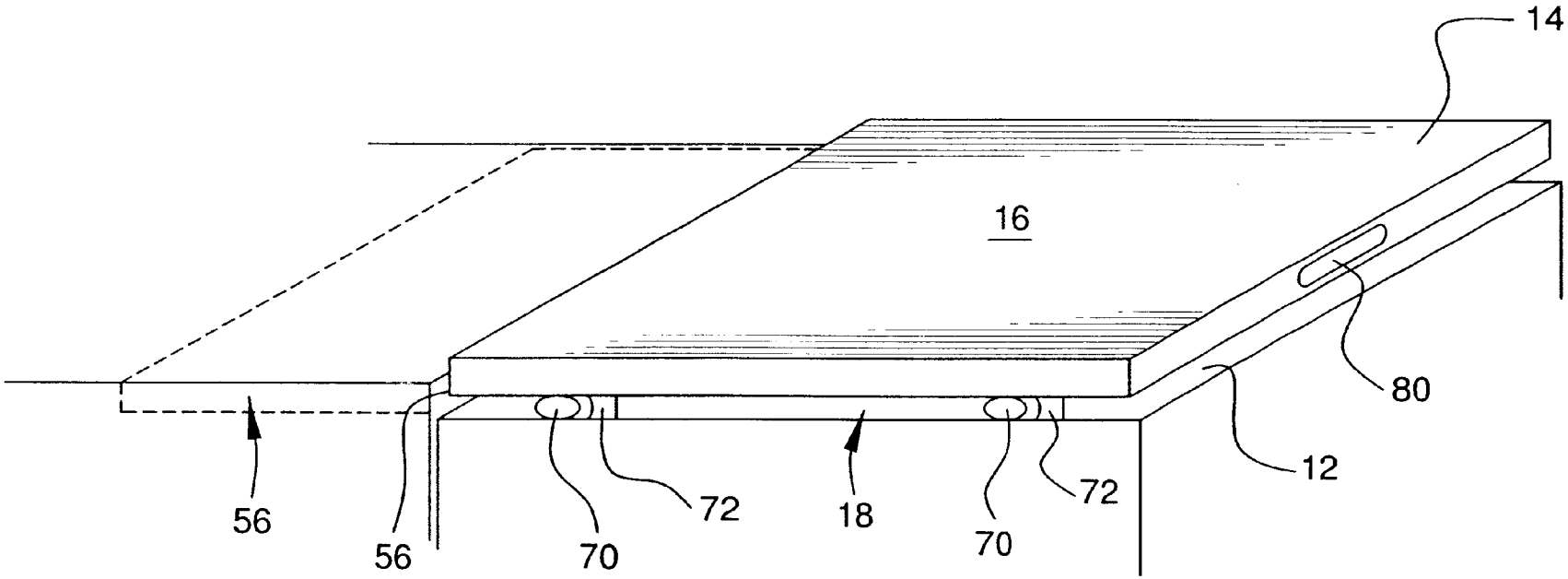
FIG. 4 is a schematic diagram illustrating an embodiment of the cover.
Figure 5:
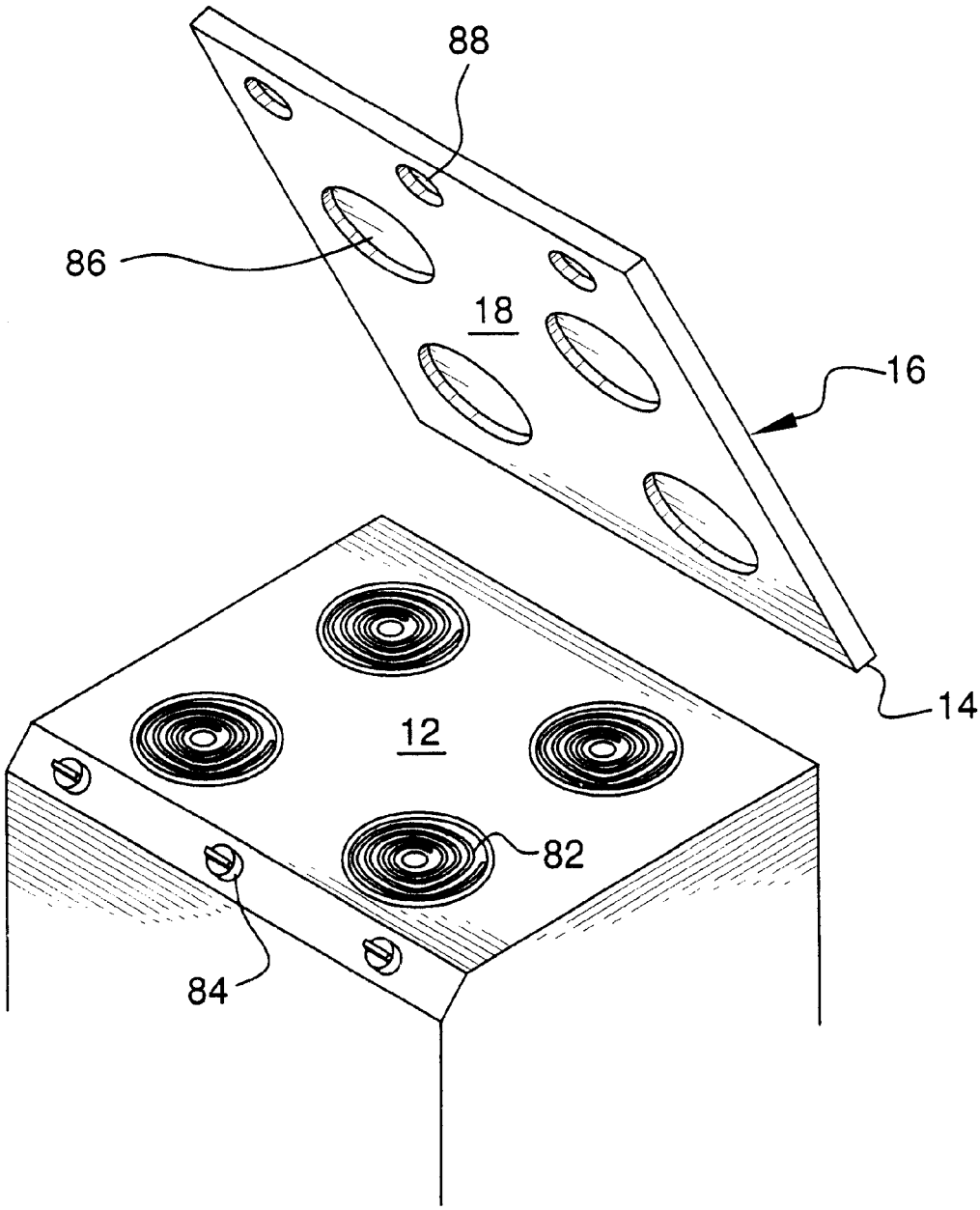
FIG. 5 is a schematic diagram illustrating an embodiment of the cover.

In order to improve the storability of the primary flat section 14, the under side of the primary flat section 14 may include a low friction mechanism 70, such as wheels or a roller. This low friction mechanism 70 allows for the primary flat section 14 to roll for storage alongside the range 12, or may allow the primary flat section 14 to be slid, without folding, into the storage compartment 56, wherein the sliding of the primary flat section 14 is performed along the top of the range top 12, as shown in FIG. 4. The primary flat section 14 may include a lock 72 that locks the low-friction mechanism 70. The primary flat section 14 may further include a handle 80 for grasping upon sliding.

The upper surface of a range 12 may include a plurality of burners 82, as well as a plurality of knobs 84. Therefore, the under side of the primary flat surface may include a plurality of burner cut-outs 86 for placement over the plurality of burners 82 on the range top. Further, the under side may include at least one knob cut-out 88 for placement over the knobs 84 of the range top. These allowances for differing heights along the range top 12 allow for improved integration with the adjacent countertop heights.

Those of ordinary skill in the art will recognize that many modifications and variations of the present invention may be implemented. The foregoing description and the following claims are intended to cover all such modifications and variations.

What is claimed is:

1. A counter top system for providing additional counter space for placement over a range top adjacent to at least one countertop, comprising:

a primary flat section having a first perimeter sized equivalently to a second perimeter of the range top, and having an upper side and an under side, wherein said primary flat section is fittedly integrated along the first perimeter with the at least one countertop adjacent to the range top on at least one side of the range top, wherein the fitted integration provides an additional counter space in conjunction with the at least one countertop, wherein said primary flat section includes at least one seam, and wherein, upon folding of said primary flat section along the at least one seam, an area of the first perimeter is decreased, wherein, upon unfolding of said primary flat section, said primary flat section is sized equivalently to the second perimeter, wherein the at least one adjacent countertop includes therein a storage compartment, and wherein, upon folding of said primary flat section along the at least one seam, said primary flat section is stored in the storage compartment, and wherein the storage compartment comprises a hinged section of the at least one adjacent countertop, wherein, upon opening of the hinged section, the folded primary flat section is stored therein.

* * * * *